US005249371A

United States Patent [19]

Saito et al.

[11] Patent Number: 5,249,371

[45] Date of Patent: Oct. 5, 1993

[54] VAPOR DRIER

[75] Inventors: Yoshio Saito, Ohme; Masaru Umeda, Tokyo; Kohei Ninomiya; Masao Kikuchi, both of Ichihara, all of Japan

[73] Assignee: Kabushiki-kaisha Hitachi Seisakusho, Tokyo, Japan

[21] Appl. No.: 779,026

[22] Filed: Oct. 18, 1991

[30] Foreign Application Priority Data

Oct. 19, 1990 [JP] Japan ..... 2-282820

[51] Int. Cl.[5] ..... F26B 21/06

[52] U.S. Cl. ..... 34/78; 34/78; 210/195.2

[58] Field of Search ..... 34/12, 73, 74, 76, 77, 34/22, 32, 27, 71, 72; 210/770, 771, 186, 194, 195.1, 195.2

[56] References Cited

U.S. PATENT DOCUMENTS 4,889,642 12/1989 Kaiser ..... 34/78 X 4,996,781 3/1919 Mishina et al. ..... 34/78 X 5,105,556 4/1992 Kurokawa et al. ..... 34/12

*Primary Examiner*—Henry A. Bennet

*Attorney, Agent, or Firm*—Baker & Daniels

[57] ABSTRACT

A purpose of this invention is to provide a vapor drier which can continue a process to dry efficiently objects in an extremely clean condition for a long time. A vapor drier of this invention comprises a circulating/dehydrating/refining means for refining said volatile processing liquid stored in said processing room and circulating refined fluid into said processing room, said circulating/dehydrating/refining means having at least an evaporating section to evaporate said volatile processing liquid stored in said processing room, a dehydrating section to remove water from said vapor generated in said evaporating section with a dehydrating/separating membrane, and a distilling section to distill said dehydrated vapor.

7 Claims, 2 Drawing Sheets

VAPOR DRIER

BACKGROUND OF THE INVENTION

This invention relates to a vapor drier to dry an object to be processed such as a wafer for semiconductor devices by using vapor of volatile processing liquid.

In a production process of semiconductor devices, for instance, after a semiconductor wafer is processed by particular chemicals, the chemicals are removed by washing with water and the water deposited on the wafer is removed by drying. A vapor drier is used as a device for drying semiconductor wafers.

In this type of vapor drier, isopropyl alcohol (IPA) as volatile processing liquid is put into the bottom section of a drying room with an opening at the top, a heater is set under the processing room, the IPA is heated and evaporated by this heater to fill the processing room with vapor atmosphere of this IPA, and a semiconductor wafer to be processed is exposed to the IPA vapor atmosphere to be dried. The semiconductor wafer is generally guided into the processing room together with a carrier tool. Also in the upper section of the processing room is arranged a cooling means for liquefying IPA vapor that comprises, for instance, a cooling coil arranged inside the top opening and other components.

The drying process can be explained as follows. As the wafer guided into the processing room has been washed with pure water at the room temperature in the previous process, much water is deposited on this semiconductor wafer when said wafer is guided into the processing room, and furthermore temperature of the semiconductor wafer is almost the same as the room temperature. For these reasons, when the wafer is guided into the processing room, the IPA vapor is condensed and liquefied on the surface of the wafer due to the difference of the temperature between the wafer and hot IPA vapor atmosphere. And the water deposited on the surface of the wafer is dissolved into the liquefied IPA, and the dissolved materials gradually go off from the surface of the wafer, so the wafer is dried by and by.

As a prior document disclosing this type of vapor drier, for instance, Japanese Laid-Open Patent Publication No. 58-207638 can be listed.

In the structure of the conventional vapor drier as described above, water deposited on wafers or the carrier tool, moisture in the air which is condensed on the surface of the cooling coil in the upper section of the processing room, and impurities are accumulated in the processing room when the wafers and the carrier tool are guided into the processing room. For this reason, as the wafer drying process is repeated many times, composition of IPA in the processing room largely changes. In other words, in the conventional type of devices, a content of water and a content of impurities in IPA in the processing room increase as time passes.

Here, increase of water content in IPA in the processing room becomes naturally a great cause for failures in the wafer drying process. Note that logically water content continues to increase to an azeotropic point between IPA liquid and water. Furthermore, if a content of impurities in the IPA liquid is large, when the IPA liquid is heated and boiled by the heater and splashes are generated, the impurities (foreign materials) deposit on the surface of the wafer, which also causes a failure in the drying process.

In order to reduce the probability of generation of failures in the conventional wafer drying process, an operation of the vapor drier is stopped periodically, and IPA liquid residing in the processing room is discharged and exchanged with fresh liquid, while operation of the vapor drier is down.

However, although failures in the wafer drying process can be reduced by frequently exchanging IPA liquid, as practical operating time of the vapor drier is reduced every time the hot IPA liquid is exchanged, throughput in the wafer process becomes lower.

Also, if the work to exchange the IPA liquid must be made frequently, workers are exposed to the IPA liquid many times, which is problematic for health control and economically disadvantageous because use rate of the IPA liquid goes higher.

For these reasons, various examinations have been carried out to make the exchange interval of the IPA liquid as long as possible by taking into account allowance in the wafer process, or to reduce a content of water accumulated in the processing room by taking into account the structure of the processing room. However, these methods are temporary, and can not be substantial solutions.

A purpose of this invention is to provide a vapor drier which can continue a process to dry efficiently objects to be dried in an extremely clean condition for a long time.

SUMMARY OF THE INVENTION

To achieve the above-described purpose, the present invention provides a vapor drier constructed in such a way that processing room is filled with vapor of volatile liquid and an object to be processed is exposed to said vapor atmosphere, and the vapor drier is characterized in that a circulating/dehydrating/refining means to refine the volatile liquid residing in the processing room and to circulate said refined fluid into the processing room is arranged in the processing room and the circulating/dehydrating/refining means includes at least an evaporating section to evaporate the volatile processing liquid residing in the processing room, a dehydrating section to dehydrate vapor generated in said evaporating section with a dehydrating/separating membrane, and a distilling section to distill said dehydrated vapor.

In brief, in a vapor drier according to this invention, a means for discharging volatile processing liquid residing in the processing room, dehydrating and refining said discharged volatile processing liquid and recycling said refined volatile processing liquid to the processing room to use it again is arranged, and purity and composition of the volatile processing liquid residing in the processing room are maintained for a long time at the same levels as those of the fresh volatile processing liquid.

More concretely, the means for dehydrating and refining the volatile processing liquid has a such a structure that the volatile processing liquid is evaporated to vapor state, temperature of which is higher than the boiling point of said volatile processing liquid, the vapor is passed through a dehydrating/separating membrane module, and the dehydrate vapor is distilled.

With the above-described means, a process, wherein a volatile processing liquid such as IPA liquid is supplied to a processing room, the processing room is filled with vapor of the volatile processing liquid, then an object to be processed with water and impurities deposited on the surface thereof is exposed to said vapor atmosphere, vapor of the volatile processing liquid is condensed on the surface of the object to be processed to dissolve water and impurities deposited on the surface, and said processing liquid with water and impurities dissolved therein goes off from the surface of the object to be processed, can be repeated to well dry the object to be processed.

In this process, the processing liquid going off from the surface of the object to be processed and the volatile processing liquid cooled and liquefied in the processing room reside at the bottom of the processing room. Then the residing processing liquid is returned again to the processing room after dehydrated and refined by the circulating/dehydrating/refining means. For this reason, the processing liquid residing in the processing room can be maintained at a constant and high purity for a long time, and also a process to dry the object to be processed can always be carried out in a clean condition as possible.

DESCRIPTION OF THE PREFERRED EMBODIMENTS

Description is made hereinafter for embodiments of this invention with reference to drawings.

Figure 1:
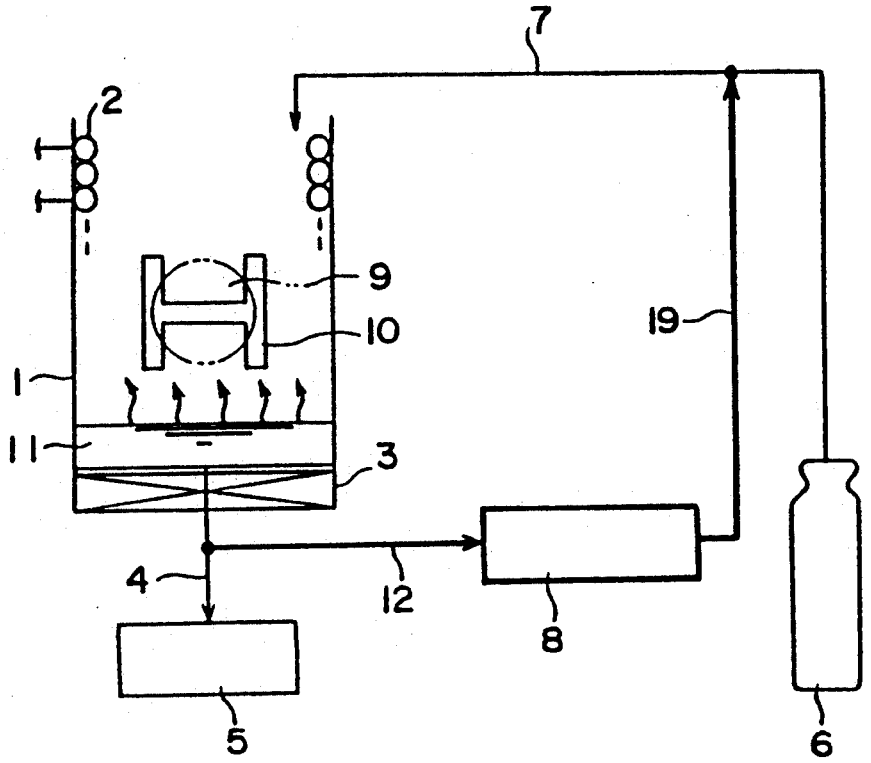
FIG. 1 is a block diagram showing the structure of the first embodiment according to this invention.

FIG. 1 shows a first embodiment of the vapor drier according to this invention. As shown in this figure, a drying process room 1 comprises a pillar-shaped body with an opening at the top thereof, a horizontal cross-section of which is, for instance, square, and inside the opening at the top thereof is displaced a spiral cooling coil 2, and a cooling water supplier (not shown in the figure) is communicated to said cooling coil 2. Also, a heater 3 is displaced at the bottom of the said processing room 1, and under the heater 3 is arranged a waste liquid recovery room 5 communicated through a waste liquid conductor 4 having a valve (not shown in the figure) to the bottom section of the processing room 1. Furthermore, outside the aforesaid processing room 1 is displaced an IPA feed section 6 in which isopropyl alcohol (IPA), volatile processing liquid, is stored, and a feed liquid conductor 7 having a valve (not shown in the figure) on its way is communicated to said IPA feed section 6 with a tip section of said liquid feed conductor 7 facing the inside of the opening in the upper section of the processing room 1.

In addition, a circulating/dehydrating/refining section 8 is arranged between the waste liquid conductor 4 and the feed liquid conductor 7. A semiconductor wafer 9, an object to be processed, and a carrier tool 10 to store said semiconductor wafer 9 are inserted into the processing room 1 and a specified quantity of IPA liquid resides at the bottom of said processing room 1.

Figure 2:
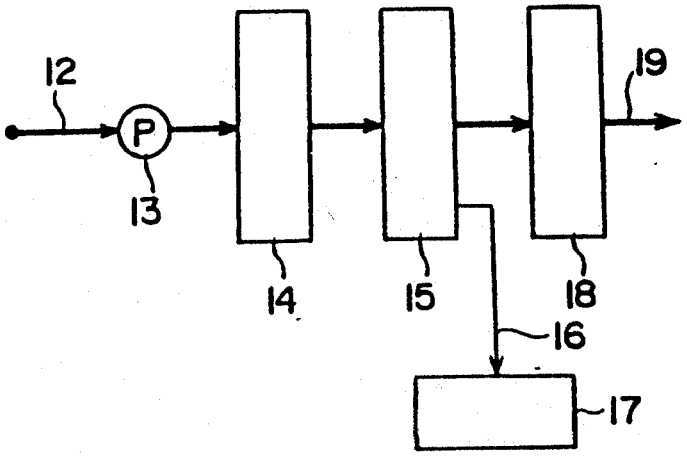
FIG. 2 is a block diagram showing a key section of the circulating/dehydrating/refining section shown in FIG. 1.

FIG. 2 shows a concrete structure of the circulating-/dehydrating/refining section 8.

A liquid inlet side of said circulating/dehydrating/refining section 8 is communicated to the waste liquid conductor 4 through a suction pipe 12, and said suction pipe 12 is communicated to a pump 13 which can suck and discharge the IPA liquid at a constant flow rate. In addition, an evaporator 14, which heats the IPA liquid to a temperature higher than the boiling point of the IPA liquid to generate the IPA vapor is communicated to the rear stage of said pump 13, and in the rear stage of said evaporator is installed a dehydrating/separating membrane module 15, including a vapor dehydrating-/separating membrane made of e.g. polyimide, which can separate the IPA vapor from moisture. A gas exhaust set 17 comprising a vacuum pump, etc., is connected to the module 15 through a gas exhaust conductor 16 to discharge separated moisture and others to outside the processing system.

Furthermore, a distillation column 18 to remove particles and dissolved metals from IPA vapor from which moisture has been separated for improving separability is arranged at the rear stage of the separating membrane module 15. In said distillation column 18 is arranged a return flow cooler to promote the rectification effect near the top of the distillation column. Said distillation column 18 is connected to the conductor 7 through the return conductor 19.

Next, description is made below for operation of the first embodiment having the structure as described above.

First, when the IPA liquid is supplied from the IPA liquid feed section 6 into the drying process room 1 and the IPA residing at the bottom of the processing room 1 is heated by the heater 3, the inside of said processing room 1 is filled with vapor of the IPA liquid. In this state, a process in which, if the semiconductor wafer 9 washed with water as a pre-processing is exposed to the vapor atmosphere, the IPA vapor is condensed on the surface of the wafer 9 to dissolve water and impurities and the IPA liquid with said water and impurities dissolved therein goes off from the surface of the object to be processed, is repeated to dry the object to be processed.

In this process, the IPA liquid which goes off from the surface of the wafer 9 and the IPA liquid which has been cooled and liquefied by the cooling coil 2 reside at the bottom on the processing room 1, but a portion of said residing IPA liquid is sucked through the suction conductor 12 into the circulating/dehydrating/refining section 8, and the remaining portion flows into the waste liquid recovery room 5.

The circulating/dehydrating/refining section 8 sucks the IPA liquid at the bottom of the processing room 1 by the pump 13, and the IPA liquid 11 discharged from said pump 13 is introduced into the evaporator 14 and then evaporated at a temperature higher than the boiling point. Said evaporated IPA vapor in an overheated state is introduced into the separating membrane module 15, and moisture which passed through the membrane is separated and removed.

The concentration of IPA before passing through the membrane can freely be controlled by adjusting factors such as discharging flow rate and discharging pressure of the pump 13, a membrane area of the vapor dehydrating membrane, or a degree of vacuum in the separating membrane module 15 by the gas exhaust set 17.

The IPA vapor, which passed through the separating membrane module 15, is guided into the distillation column 18, and in said distillation column 18, the IPA fluid is refined at the extracting section of said distillation column 18 by repeating countercurrent contact between the vapor and the liquid and also by circulating the liquid between the column head, and the return flow cooler is obtained. The IPA fluid thus dehydrated and refined is poured into the processing room 1 through the return conductor 19 and the conductor 7.

In the structure of this embodiment as described above, dehydration and refinement (purification) of the IPA liquid in the processing room 1 are performed repeatedly, so that purity of the IPA liquid 11 residing in the processing room 1 can be maintained at a constant level for a long time, and a process to dry the wafer 9 is carried out in a clean state.

Figure 3:
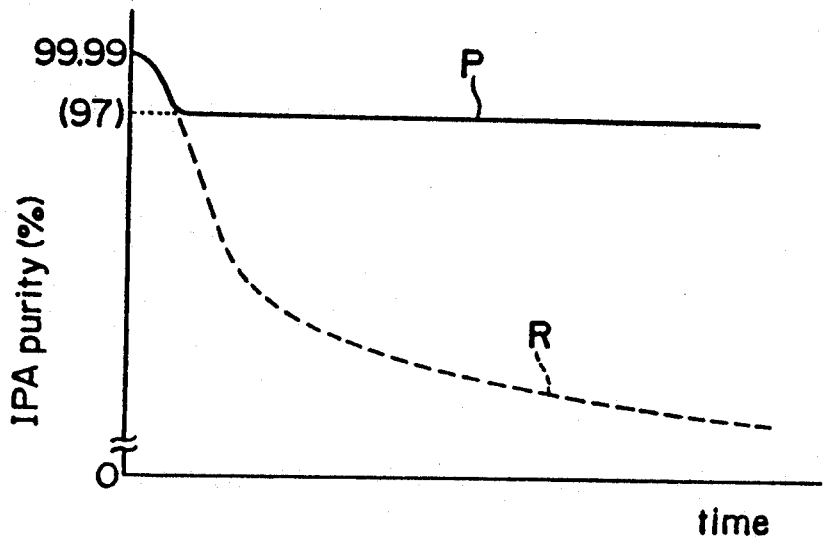
FIG. 3 is a graph showing time-seriesed change of IPA purity.

FIG. 3 shows the comparison between this embodiment and a conventional device in relation to the change of purity of the IPA liquid in the processing room 1 as a function of elapsed time. The curve P shown with a solid line represents an example of experiment according to the present embodiment. If purity of the IPA liquid is the highest degree (for instance, 99.99%) when operation of the device starts, the purity lowers a little to, for instance, 97% after time passes, but after that the high purity is maintained at almost the same level. On the other hand, the curve R shown by a broken line is an example of experiment in which a conventional device was used, showing that purity of the IPA liquid acutely lowers as time passes within a short period of time and the purity continues to gradually lower.

Figure 4:
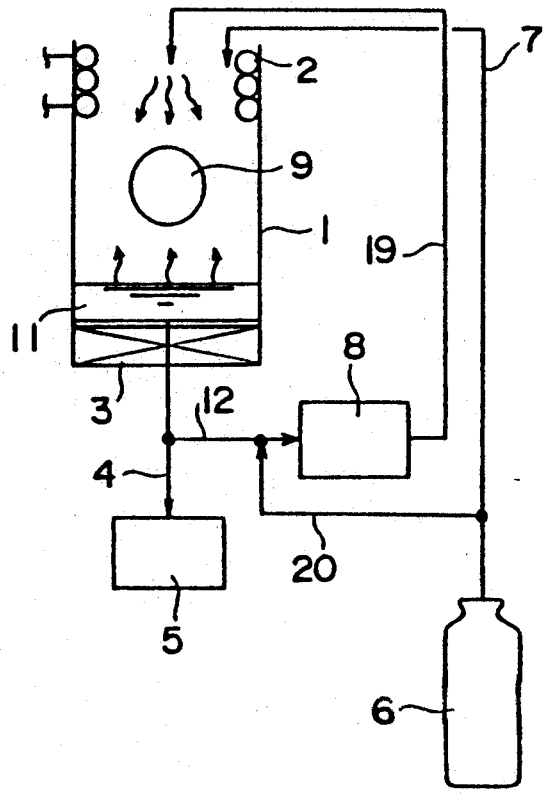
FIG. 4 is a block diagram showing the second embodiment of this invention.

FIG. 4 shows a second embodiment of the invention, wherein, in the circulating/dehydrating/refining section 8, a column head section of the distillation column 18 is connected to the processing room 1 through the return conductor 19 (and, if necessary, a branching conductor 20 is arranged between the liquid feed conductor 7 and the suction conductor 12 to distill the fresh IPA liquid from the IPA feed section 6), and a portion of high purity IPA vapor obtained in the column head section of the distillation column 18 is directly released from a tip section of said return conductor 19. Other portions of the structure and effects are the same as those of the first embodiment, so explanation of them is omitted here.

With this structure, purity of the IPA vapor atmosphere in the processing room 1 can be maintained at a higher level than that in a structure where only waste liquid in the processing room 1 is recycled.

Figure 5:
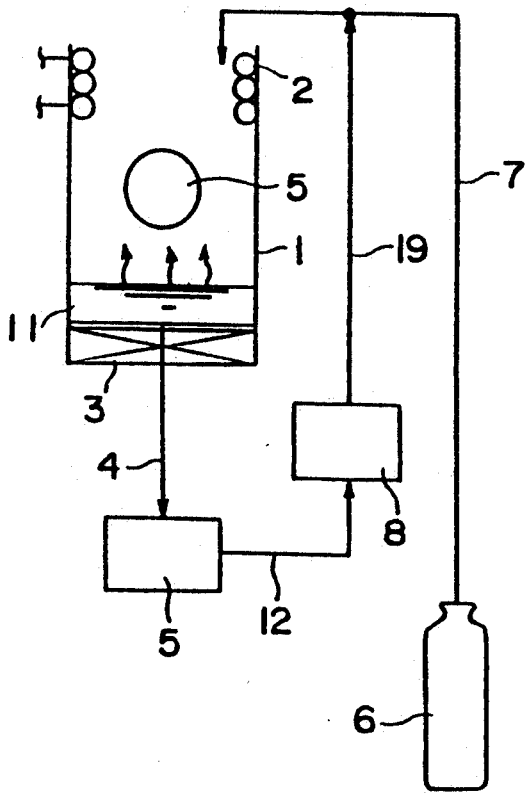
FIG. 5 is a block diagram showing the third embodiment of this invention.

FIG. 5 shows a third embodiment of this invention, wherein so-called the completely closed type of waste liquid recovery is performed by connecting the suction pipe 12 to the recovery room 5 in the circulating/dehydrating/refining section 8 and by refining, dehydrating and returning all of the IPA liquid stored in the waste liquid recovery room 5. Other portions of the structure and the effects are the same as those of the first embodiment, so explanation of them is omitted here.

This structure insures higher efficiency in recycling the waste liquid and is economically advantageous.

Explanations of each of the embodiments described above assume that the object to be processed is the semiconductor wafer 9, but this invention can also be applied to various processes to dry, for instance, various types of objects such as optical disks, magnetic disks, photomasks, and lenses.

As described above, the vapor drier according to the invention described in claim 1 wherein the processing room is filled with vapor of a volatile processing liquid and an object to be processed is exposed to said vapor atmosphere characterized in that a circulating/dehydrating/refining means for refining the volatile processing liquid residing in the processing room and returning said refined fluid to the processing room, so that the water content and a impurity content can be reduced as much as possible, purity of the processing liquid can be maintained at the same high level as fresh processing liquid for a long time, and an object to be processed can always be dried in an extremely clean state.

Also, as a frequency of exchange of the processing liquid is remarkably reduced, a quantity of the processing liquid can largely be reduced, which means that this structure is economically far more excellent than the existing devices, and at the same time an availability factor of the device becomes substantially higher and throughput in a process to dry objects to be processed can largely be improved, so that chances for workers to contact chemicals decrease, which contributes to improvement of workers' health control.

Furthermore, as the circulating/dehydrating/refining means according to the invention described in claim 1 is characterized in that said means comprises an evaporating section to evaporate the residing volatile processing liquid, a dehydrating section to dehydrate vapor generated in said evaporating section, and a distilling section to distill said dehydrated vapor, dehydration and refinement (purification) of the processing liquid can be realized practically and concretely, in addition to the effects as described above.

As the dehydrating section according to the invention is characterized in that the dehydrating section comprises a dehydrating/separating membrane which can process vapor generated in the evaporating section under high temperature, separation of water can be performed efficiently in addition to the effects obtained because of the invention.

As the dehydrating/separating membrane according to the invention is characterized in that said membrane is a vapor dehydrating membrane made of polyimide, dehydrating/separating membrane can easily be obtained.

As the distilling section according to the invention is characterized in that said distilling section comprises at least a distillation column having a return flow cooler, the processing liquid can be dehydrated and refined to a higher purity.

As the distilling section according to the invention is characterized that the column head section of said distilling section is connected to the aforesaid processing room, in addition to the effects of the invention, an object to be processed can be dried more efficiently.

As the volatile processing liquid according to the invention is characterized in that said processing liquid is alcohol, the volatile processing liquid can easily be obtained.

As the object to be processed according to the invention is characterized in that said object is a semiconductor wafer, a yield in production of semiconductors, where an especially high integration degree is required, can remarkably be improved.

What we claim is:

1. A vapor drier for drying an object to be processed by filling a processing chamber with vapor of volatile processing liquid and exposing said object to said vapor; said vapor drier comprising:

a circulating/dehydrating/refining means for refining said volatile processing liquid stored in said processing chamber and circulating refined fluid into said processing chamber, said circulating/dehydrating/refining means having at least an evaporating section to evaporate said volatile processing liquid stored in said processing chamber, a dehydrating section to remove water from said vapor generated in said evaporating section with a dehydrating/separating membrane, and a refining section to remove particles and dissolved metals from said dehydrated vapor by the contact of said dehydrated vapor with the condensed liquid thereof.

2. A vapor drier according to claim 1, wherein said dehydrating section comprises a dehydrating/separating membrane which can process vapor generated in said evaporating section under high temperature.

3. A vapor drier according to claim 2, wherein said dehydrating/separating membrane is a vapor-dehydrating membrane made of polyimide.

4. A vapor drier according to claim 1, wherein said refining section comprises a distillation column having a reflux condenser.

5. A vapor drier according to claim 4, wherein in said refining section, the top section of said distillation column is in communication with in said processing chamber.

6. A vapor drier according to claim 1, wherein said volatile processing liquid is alcohol.

7. A vapor drier according to claim 1, wherein said object to be processed is a semiconductor wafer.

* * * * *

UNITED STATES PATENT AND TRADEMARK OFFICE

CERTIFICATE OF CORRECTION

PATENT NO. : 5,249,371

DATED : October 5, 1993

INVENTOR(S) : Yoshio Saito et al

It is certified that error appears in the above-identified patent and that said Letters Patent is hereby corrected as shown below:

On the Title Page, under Item [73] Assignee:
in addition to "Kabushiki-Kaisha Hitachi Seisakusho, Tokyo, Japan", please add the following two Assignees:

--Kabushiki-Kaisha Watanabe Shoko, Tokyo, Japan; and

Ube Kosan Kabushiki-Kaisha, Yamaguchi-ken, Japan--

Signed and Sealed this

Twelfth Day of July, 1994

*Attest:*

Bruce Lehman

BRUCE LEHMAN

*Attesting Officer*

*Commissioner of Patents and Trademarks*